US010743675B2

(12) United States Patent
Codos

(10) Patent No.: US 10,743,675 B2
(45) **Date of Patent: *Aug. 18, 2020**

(54) PILLOW

(71) Applicant: Richard Codos, Warren, NJ (US)

(72) Inventor: Richard Codos, Warren, NJ (US)

(73) Assignee: SLEEPOVATION LLC, East Hanover, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/360,217

(22) Filed: Mar. 21, 2019

(65) Prior Publication Data

US 2019/0216241 A1 Jul. 18, 2019

Related U.S. Application Data

(63) Continuation-in-part of application No. 16/259,353, filed on Jan. 28, 2019, now Pat. No. 10,624,468, which is a continuation-in-part of application No. 14/801,790, filed on Jul. 16, 2015, now Pat. No. 10,188,219, which is a continuation-in-part of application No. 14/695,063, filed on Apr. 24, 2015, now Pat. No. 9,661,932.

(Continued)

(51) Int. Cl.

| | |
|---|---|
| ***A47C 27/06*** | (2006.01) |
| ***A47C 27/05*** | (2006.01) |
| ***A47C 27/04*** | (2006.01) |
| ***A47G 9/10*** | (2006.01) |

(52) U.S. Cl.

CPC ..... *A47C 27/053* (2013.01); *A47C 27/04* (2013.01); *A47C 27/05* (2013.01); *A47C 27/056* (2013.01); *A47C 27/064* (2013.01); *A47G 9/10* (2013.01)

(58) Field of Classification Search

CPC ..... A47C 23/04; A47C 23/043; A47C 23/064; A47C 23/065; A47C 27/04; A47C 27/05; A47C 27/053; A47C 27/056; A47C 27/06; A47C 27/062; A47C 27/064; A47C 27/14; A47C 27/148; A47C 27/15

USPC ..... 5/239, 241, 243, 245, 642, 654.1, 655.7, 5/655.8, 716, 720, 727, 728

See application file for complete search history.

(56) References Cited

U.S. PATENT DOCUMENTS 975,695 A * 11/1910 Knuppen ..... A47C 27/064 5/655.8
3,191,197 A * 6/1965 Frey ..... A47C 27/144 5/243

(Continued)

*Primary Examiner* — Robert G Santos
(74) *Attorney, Agent, or Firm* — Steven N. Fox, Esq.

(57) ABSTRACT

Disclosed is a pillow comprising a plurality of pocket springs each comprising a coil spring and a pocket. Each of the pockets comprise a top portion and a bottom portion. Each of the pockets are formed from a continuous top piece of fabric attached to a continuous bottom piece of fabric to form a bond having a plane perpendicular to the longitudinal axis of each coil spring. The pillow further comprises an attachment layer comprising a top portion comprising an inner and outer surface. The pillow further comprises a plurality of first cushion elements engaged with the outer surface of the top portion of the attachment layer. The inner surface of the top portion of the attachment element is engaged with the top portion of the pockets of the pocket springs such that each of the first cushion elements act only upon one of the pocket springs.

9 Claims, 9 Drawing Sheets

Related U.S. Application Data

(60) Provisional application No. 62/134,406, filed on Mar. 17, 2015.

(56) References Cited

U.S. PATENT DOCUMENTS

| | | | | | |
|---|---|---|---|---|---|
| 3,462,779 | A * | 8/1969 | Thompson | A47C 27/063 | 5/655.8 |
| 4,485,506 | A * | 12/1984 | Stumpf | A47C 27/064 | 267/83 |
| 5,231,718 | A * | 8/1993 | Blaha | A47C 27/088 | 5/719 |
| 9,661,932 | B2 * | 5/2017 | Codos | A47C 27/064 | |
| 9,949,571 | B2 * | 4/2018 | Codos | A47C 27/064 | |
| 10,188,219 | B2 * | 1/2019 | Codos | A47C 27/064 | |
| 10,368,655 | B2 * | 8/2019 | Codos | A47C 27/064 | |
| 2016/0270545 | A1 * | 9/2016 | Codos | A47C 27/064 | |
| 2016/0270546 | A1 * | 9/2016 | Codos | A47C 27/064 | |
| 2017/0258242 | A1 * | 9/2017 | Codos | A47C 27/056 | |
| 2019/0150630 | A1 * | 5/2019 | Codos | A47C 27/07 | |
| 2019/0183253 | A1 * | 6/2019 | Codos | A47C 27/064 | |
| 2019/0216241 | A1 * | 7/2019 | Codos | A47C 21/046 | |
| 2019/0343295 | A1 * | 11/2019 | Codos | A47C 27/064 | |

* cited by examiner 10
99
20
20
20

10
99
20
20
20

10
Force F1
Airflow A1
Airflow A1
Airflow A1
Airflow A1
Airflow A1
Airflow A2
99
20
20
20

PILLOW

CROSS-REFERENCE TO RELATED APPLICATIONS

This application claims priority to and is a continuation-in-part of U.S. Utility application Ser. No. 16/259,353 filed on Jan. 28, 2019, that claims priority to and is a continuation-in-part of U.S. Utility application Ser. No. 14/801,790 filed on Jul. 16, 2015, now U.S. Pat. No. 10,188,219, that claims priority to U.S. Utility application Ser. No. 14/695,063 filed on Apr. 24, 2015, now U.S. Pat. No. 9,661,932, that claims priority to U.S. Provisional Application Ser. No. 62/134,406 filed on Mar. 17, 2015, all of which are hereby incorporated into this specification by reference in their entirety.

BACKGROUND OF THE INVENTION

Pillows on the market today are built in one of several different ways. Firstly, the pillow can be made from a randomly oriented filling material. An example of this construction is a pillow that is composed of randomly oriented polyester fiber-fill. This construction is not limited to a randomly oriented polyester fiber, but can also include, but is not limited to, wool, cotton, or other fibers in which the material fibers are oriented in random orientations. It is also possible to construct a pillow from randomly oriented solid structures. This type of construction is consistent with pillows made from small foam blocks that are randomly dispersed inside the pillow casing. The foam elements can be made from, but not limited to, man-made foams such a poly foam or visco-elastic foam, to various types of natural foams such as latex foam. In addition to the random orientation of the foam elements, additionally the foam elements can consist of different sizes and shapes. It is also possible to mix different foam sizes and shapes inside of a single pillow covering to create an additional level of randomness.

A second type of pillow construction is made with one or more layers of sheet filling materials within a pillow casing. Examples of this type of pillow are layered poly foam pillows in which one or more types, as well as one or more layers of poly foam are stacked upon one another and then encased in a pillow cover. The layer(s) of foam material can be either man made, such as polyfoam or visco-elastic foam, or natural such a latex. In addition, the layers of sheet foam material can be cut into different contours to allow them to better fit into different body crevices or conforming contours. Also, part of this group of pillow construction is when one or more of the sheet foam layers are fabricated to have a non-uniform surface. A top layer of convoluted foam falls into this category. This type of non-uniform foam layers allows for increased airflow as against uniform surface sheet foam layer, and well as a more localized pressure reduction versus a standard sheet foam material. The advantage of the second type of pillow construction, the uniform sheet layer filled pillow, is that this type of pillow has a uniform resilience and will not flatten out. The problem with the sheet foam pillow construction centers around two principle areas. Firstly, the very nature of sheet foam tends to restrict airflow. Additionally, the continuous sheet nature of this style of pillow does not allow spot pressure reduction. For instance, if a sleeper buries the side of their face in the pillow, areas of the face that protrude will be subjected to higher localized pressures due to the underlying sheet cushioning material not allowing for localized pressure reductions. Along these same lines, the ability of a solid layer cushioning material pillow to mold to a sleeper's anatomy is significantly reduced and compromised.

A third type of pillow construction can be formed by the combination of types one and two (hybrid pillow). This type of pillow often encompasses, but is not limited to, a solid foam center surrounded by a randomly oriented fiberfill material. This type of construction has both the advantages and disadvantages of each respective pillow construction.

A fourth type of pillow construction, that is another variation on the third type of hybrid pillow, is constructed of a pocket spring pillow core that is covered by a sheet cushioning layer. The spring core is of a pocket spring construction like that used in pocket spring mattresses but scaled down to fit into a pillow. This type of spring hybrid pillow has the advantage of being more responsive and reactive than other style pillows because of the spring core. Sometimes a random fiber, or cutup foam, cushioning layer is placed over the spring unit to isolate the springs from the sleeper. In other instances, a solid foam sheet cushioning layer is utilized with a spring core to ensure that the springs will not be felt through the cushioning layer. If a random fill fiber or foam covering is used over the spring core, there is a high probability that the spring core of the pillow can become palpable to a sleeper. However, if the spring core is covered in a sheet foam cushioning material, this spring style hybrid pillow tends to also sleep hot. Additionally, spring core pillows tend not to be flexible and foldable, and not conformable to different sleepers different sleeping demands. Basically, this pillow lies flat and does not have the flexible and foldable pillow characteristics that many sleepers desire. The reason the pillow is not flexible is due to the fact that the pockets of the pocket spring are formed with a bond having a plane that is parallel to the central axis of the coil spring. As a result, any attempt to flex the pocket spring is met with resistance as the coil springs contact each other and resist movement. The advantage of the type four hybrid pocket spring core pillow is that the pillow is both responsive and molds to the individual features of a sleeper's head allowing spot pressure reduction. However, because the pillow is constructed of pocket springs that are bonded to one another along an axis that is parallel to the plane of the spring, the springs have very little freedom of movement relative to one another. This lack of spring movement relative to one another is beneficial in a mattress construction where rigidity is important, but are a negative when considering a pillow where flexibility and moldablility are very positive pillow traits. As a result of this type of hybrid pocket spring construction, these pillows are not very flexible or foldable. Consequently, the sleeper must maintain the pillow in a flat plane. At the same time, if the pillow is covered by a random fiber or foam cushion layer, the cushion layer will tend to flatten out and eventually move into an orientation where the sleeper will feel and be exposed to the actual pocket spring core. On the other hand, if the pocket spring core is covered by a sheet foam cushioning layer, the pillow will be even more inflexible while the sheet foam layer impedes airflow and causing the sleeper and pillow to sleep hot. Furthermore, the sheet foam will exhibit a hammock effect and reduce the benefits derived from using a pocket spring core, essentially reducing the moldable, spot pressure reduction, and responsive characteristics that make this pillow construction desirable.

In all of the aforementioned pillow construction methods several benefits and corresponding shortcomings are evident. In the case of type one, the random fiberfill pillow construction, the random orientation of the filling material fibers allows for an airflow to be able to exist within the fiber construction and hence within the pillow. This allows the sleeper to not overheat when sleeping in a single position over a long period of time since air can flow within the pillow structure and around the sleeper's head. At the same time, the random orientation of the fiber filling allows the sleeper to "mold" the pillow to suit their particular needs. However, the randomness of the fibers, in allowing the pillow to easily mold, also makes the pillows resilience, or bounce back, both unpredictable and potentially compromised. This also results in a pillow that tends to "flatten out" over the course of a night's sleep. Many a sleeper will have to "fluff up" the pillow, by manually attempting to re-randomize the fibers, in an attempt to un-flatten the pillow and restore some of the pillow's original resilience. With regards to the type of construction made from small foam blocks that are randomly dispersed inside the pillow casing similar advantages and disadvantages already discussed also occur. The very nature of random orientation of the foam elements makes the pillow unpredictable in terms of resilience and in term of potentially flattening out.

SUMMARY OF THE INVENTION

What is needed is a pillow construction that incorporates the cooling and pressure relieving properties of pillow type #1 with the repeatable resilience, lack of body imprint, and lack of randomness of pillow type #2. Therefore, one object of the present invention is to provide a pillow that facilitates a continuous airflow within the pillow body by having passive air channels as part of its construction.

Another object of the present invention is to provide uniform blocks of foam, each engaged with its own pocket spring, such that the blocks of foam maintain a uniform, non-random, and predictable arrangement that will not be subject to random realignment, thereby insuring consistent pillow resilience with no flattening out.

Another object of the present invention is to create a cooling mechanism, via a passive airflow within the pillow body, that can remove excess sleeper's heat when engaged with the pillow.

Another object of the present invention is to create an active airflow within the pillow body by creating a matrix of positive displacement air pumps within the pillow cushion layer as the sleeper moves on the pillow.

Another object of the present invention is to create a pillow body that is capable of supporting airflows associated with breathing and therefore reducing the buildup of carbon dioxide when the sleeper is in a side sleeping or partial face down position. Because buildup of carbon dioxide triggers a wake-up mechanism, this feature helps insure a better night's sleep and helps mitigate the risks associated with sleep apnea.

Another object of the present invention is to help in reducing localized high-pressure interface points and conforming to face contours by providing dozens of tiny pillows within the one overall pillow.

Another object of the present invention is to allow for molding of the pillow body to the sleeper's head shape while still providing adequate and consistent resilience should the sleeper change positions.

Another object of the present invention is to create a pillow that has a constant and repeatable resiliency without any tendency of the pillow to flatten out.

Another object of the present invention is to provide a mechanism, via an attachment layer, of securing individual foam cushions to individual pocket springs thereby engaging one foam cushion with one pocket spring while at the same time giving stability to the foams cushions and pocket springs.

Another object of the present invention is to provide a mechanism to secure the individual foam cushions to the sides of pocket coil springs that will provide an out of plane cushion relative to the plane of the pocket coils along the edges of the pillow.

Another object of the present invention is to utilize a pocket coil design that allows the pocket coil core to be bent and folded in multiple axes and orientations.

In one embodiment, the present invention is a pillow comprising a plurality of pocket springs each comprising a coil spring and a pocket. Each of the pockets comprise a top portion and a bottom portion. Each of the pockets are formed from a continuous top piece of fabric attached to a continuous bottom piece of fabric to form a bond having a plane perpendicular to the longitudinal axis of each coil spring. The pillow further comprises an attachment layer comprising a top portion comprising an inner and outer surface. The pillow further comprises a plurality of first cushion elements engaged with the outer surface of the top portion of the attachment layer. The inner surface of the top portion of the attachment element is engaged with the top portion of the pockets of the pocket springs such that each of the first cushion elements act only upon one of the pocket springs.

BRIEF DESCRIPTION OF THE DRAWINGS

The following description of the present invention will be better understood with reference to the accompanying drawings in which.

DESCRIPTION OF THE INVENTION

Figure 1:
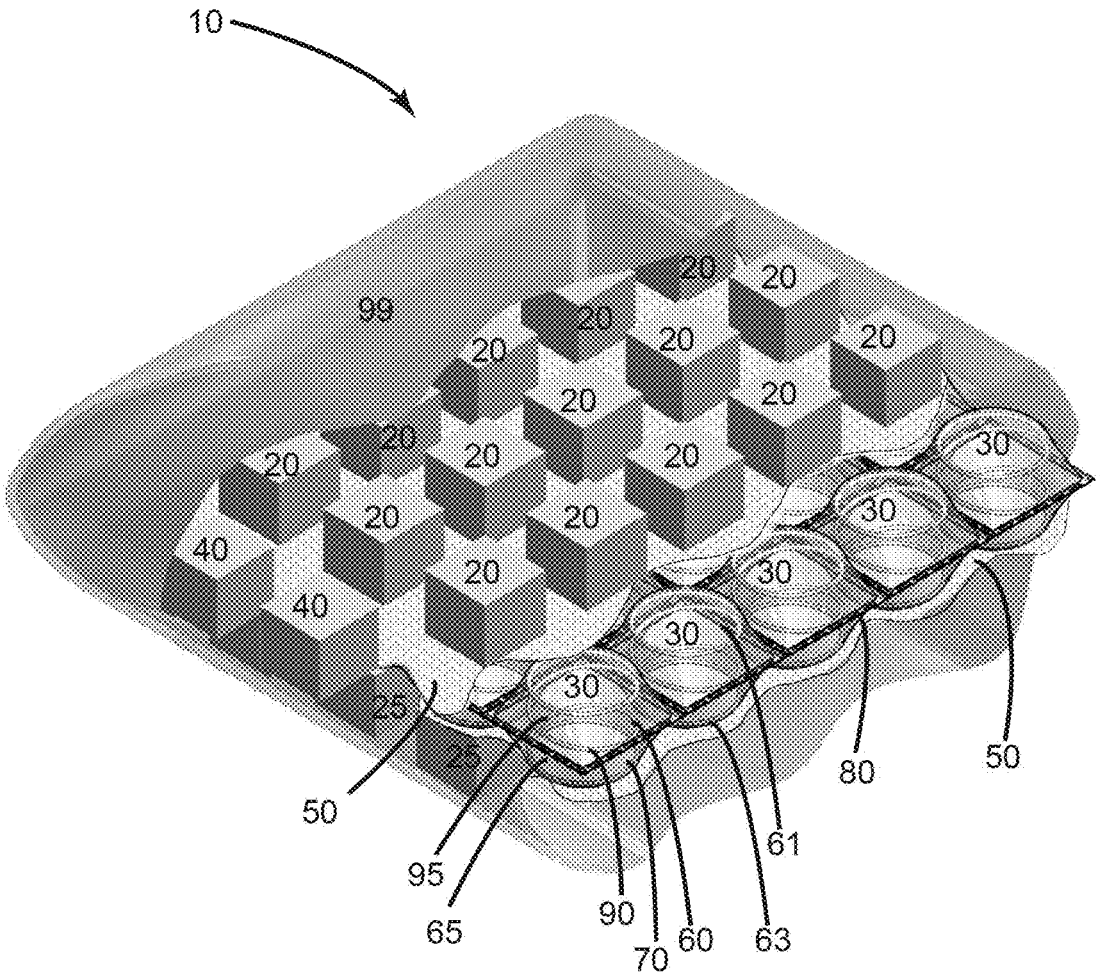
FIG. 1 is a cutaway perspective view of a pillow according to a first embodiment of the present invention shown in an unloaded stated.

Referring to FIG. 1, where a pillow 10 according to a first embodiment of the present invention. Pillow 10 comprises a fabric cover 99. Pillow 10 further comprises a plurality of pocket springs 30 disposed within fabric cover 99. Each of pocket spring 30 comprises a pocket 95 and an individual metal coil spring 90 disposed within pocket 95. Pocket 95 has a top portion 61, a bottom portion 63, and a side portion 65. Pocket 95 is made from a piece of non-woven fabric 60 (shown in transparent state for ease of viewing pocket insides), and a piece of non-woven fabric 70, (shown in transparent state for ease of viewing pocket insides), that are fused or attached together by a thermal bond 80 having a plane that is perpendicular to the central longitudinal axis of coil spring 90. Pocket 95 may be formed of other materials, including but not limited to, non-woven, woven, knit, or needle punch fabric. In addition, the fabric bonding is not limited to thermal bonds, but might include, but is not limited to, stitch or glue bonding. Furthermore, coil spring 90 is not limited to any spring type, but might also include a cone shaped, barrel, straight, or other suitable spring construction.

With continued reference to FIG. 1, pillow 10 further comprises an attachment layer 50. In the embodiment shown, attachment layer 50 is made of a non-woven fabric material. However, attachment layer 50 can be made of other suitable fabrics such as, but not limited to, knits, wovens, needle punch, foam, and other suitable constructions. In addition, the fabric weight can be of any number of different weights subject to strength and flexibility considerations. Attachment layer 50 is secured to each pocket spring 30 by a water-based adhesive such as that can be sourced from either Simalfa, Hawthorne, N.J. 07506 USA or SABA North America LLC, Kimball, Mich. 48074. However, it is envisioned that the adhesive can be, but is not limited to, a hot melt adhesive or a solvent based adhesive. Pillow 10 further comprises a plurality or layer of foam cushion elements 20, 25, and 40. Each of foam elements 20, 25, and 40 are approximately 2.25 inches×2.25 inches with a height of approximately 1.5 inches. In this manner, it is possible to have a single foam cushion element 20 and a single foam cushion element 25, each engaged with and acting only upon a single pocket spring 30. It should be obvious to one who is skilled in the art that the actual spring and foam dimensions can be varied without changing the functionality and utility of the pillow.

Figure 2:
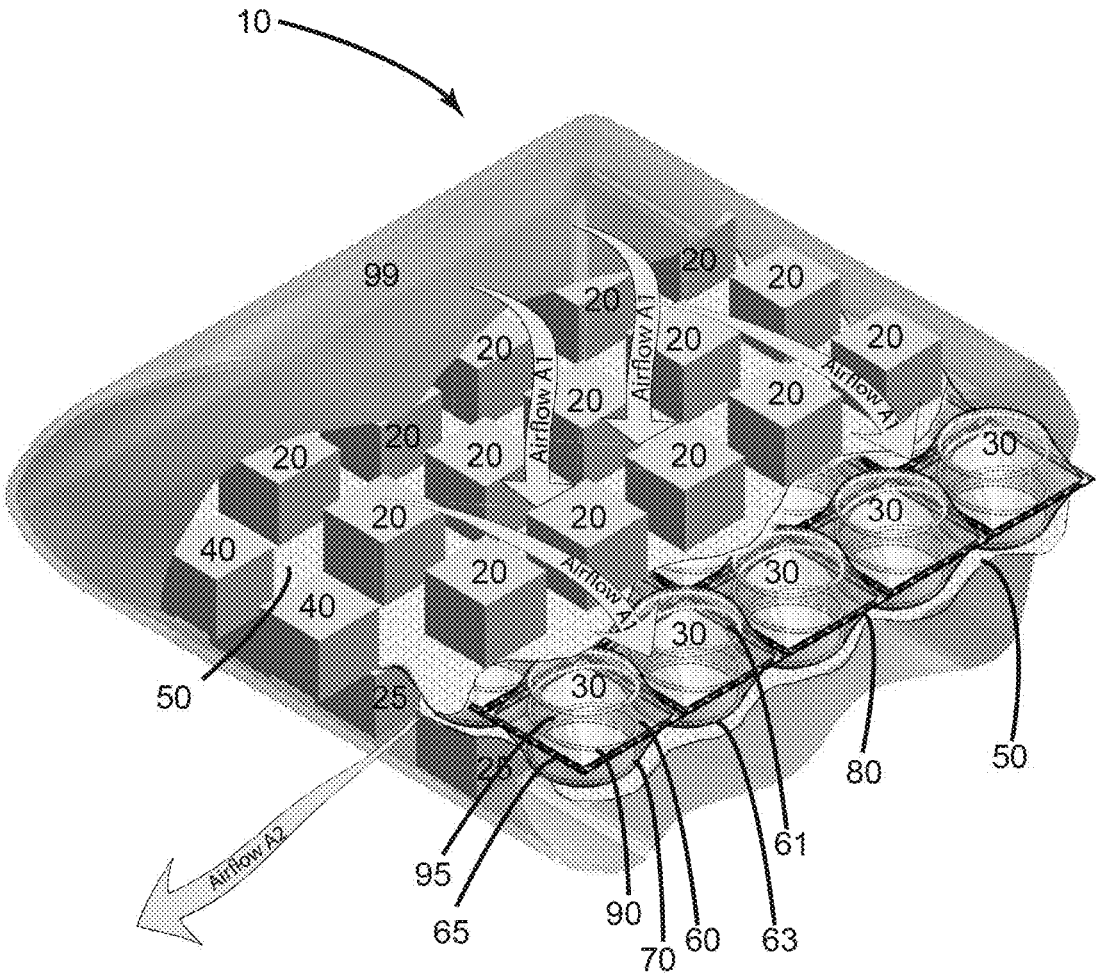
FIG. 2 is a cutaway perspective view of the pillow in an unloaded stated showing free standing cushion elements that allow air circulation around the cushion elements.

Referring to FIG. 2, attachment layer 50 provides pillow 10 with a lateral stability. Additionally, attachment layer 50 provides a connection between the cushion layer above pocket coil springs 30, containing cushion elements 20, with the cushion layer below pocket coil springs 30, containing cushion elements 25. This connection adds to the stability of pillow 10 as well as imparting a counter force to lateral sleeper movements. For instance, if the sleeper shifts their head to the left imparting a lateral force to cushions 20 above pocket springs 30, the lateral forces transmitted thru attachment layer 50 force cushions 25 below pocket springs 30 to shift to the right, thereby resisting having the pillow slide across the sleeping surface. This counterbalancing force has the added benefit of creating a very stable sleeping environment that minimalizes sleeper motions. At the same time, attachment layer 50 provides a method by which we can attach individual foam elements 20 and 25 to individual pocket springs 30. Further, by first gluing the foam cushion elements 20 and 25 to attachment layer 50, and then adhering attachment layer 50 to pocket springs 30, or visa-versa, we can manufacture a pillow in which each foam element 20 and 25 only engaged with and acting upon a single and the same pocket coil spring 30. At the same time, attachment layer 50 provides a means by which we can attach side foam cushion 40 and provide a mechanism to secure the individual side foam cushions 40 to the sides of pocket springs 30.

With continued reference to FIG. 2, air permeates pillow cover 99 and is able to freely circulate between adjacent cushion elements 20 as indicated by passive airflow A1 that is occurring in the cushion layer above pocket springs 30. At the same time, air permeates the pillow cover 99 and can freely circulate between adjacent cushion elements 25 as indicated by passive airflow A2 that is occurring in the cushion layer below pocket springs 30. As a result, passive airflow channels, A1 above pocket springs 30 and A2 below pocket springs 30 simultaneously allow air circulation to occur around the entire pillow 10. Unlike prior art type of conventional pillows, there are not one or more layers of poly foam that are stacked upon one another that act to block and restrict airflow into and out of the pillow cushion layer. Furthermore, unlike other prior art type of conventional pillows, randomly oriented fibers or foam blocks are not compressed together and reoriented so that they act to block and restrict airflow into and out of the pillow cushion layer.

Figure 3:
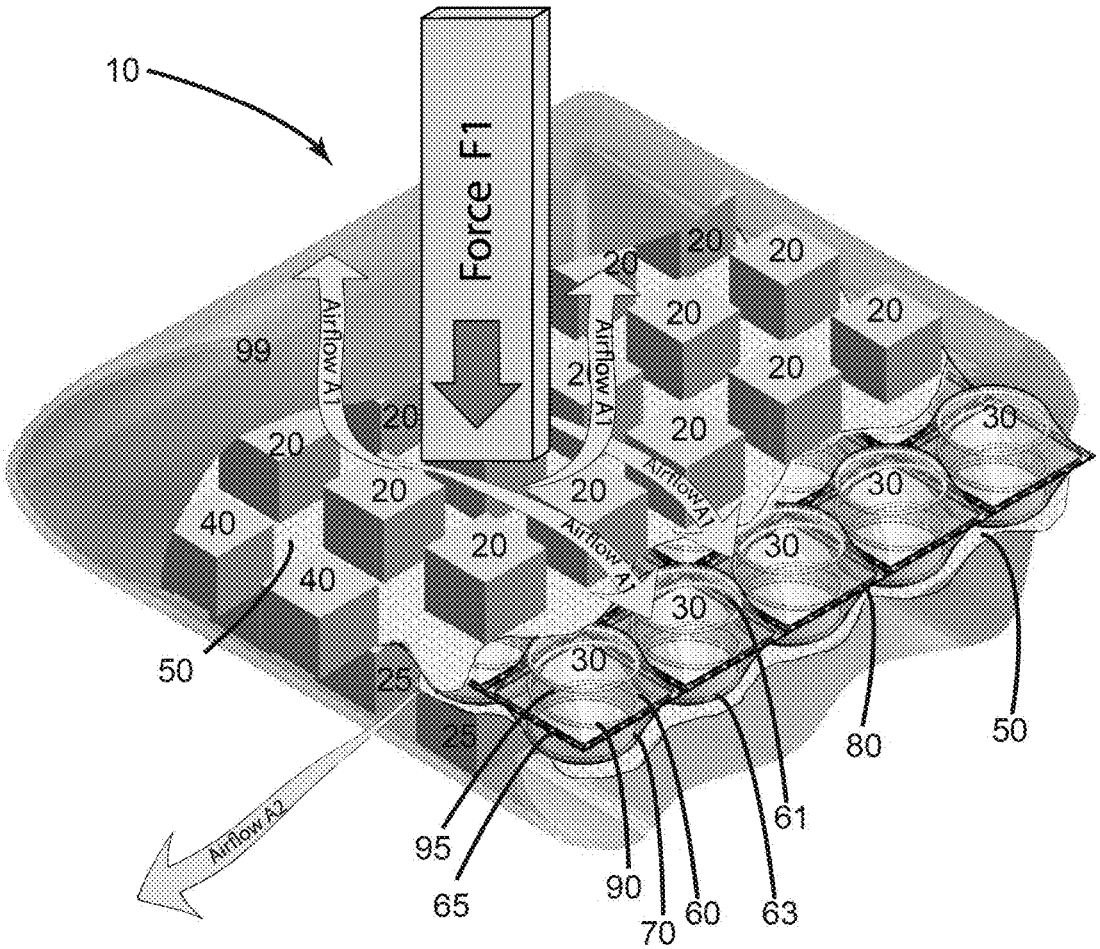
FIG. 3 is a cutaway perspective view of the pillow in a partially loaded state by a compressive force on one or more of the cushion pockets that results in a positive displacement of air around the cushion pockets.

Referring to FIG. 3, where pillow 10 is now subjected to an external compressive force F1 that creates the equivalent of a positive displacement air pump within pillow 10. This pumping action induces eddy currents and airflows within the pillow cushion layers. Since the individual cushion elements 20 are not connected and air is allowed to freely flow throughout the cushion layer, a positively generated airflow A1, is generated in the cushion layer that resides above pocket spring units 30. At the same time, a positively generated airflow A2, is generated in the cushion elements 25 that resides below pocket springs 30. As a result of a sleeper's head movement, pillow 10 acts as a positive displacement air pump both above and below the pocket coil layer and circulates air around the entire pillow 10.

Figure 4:
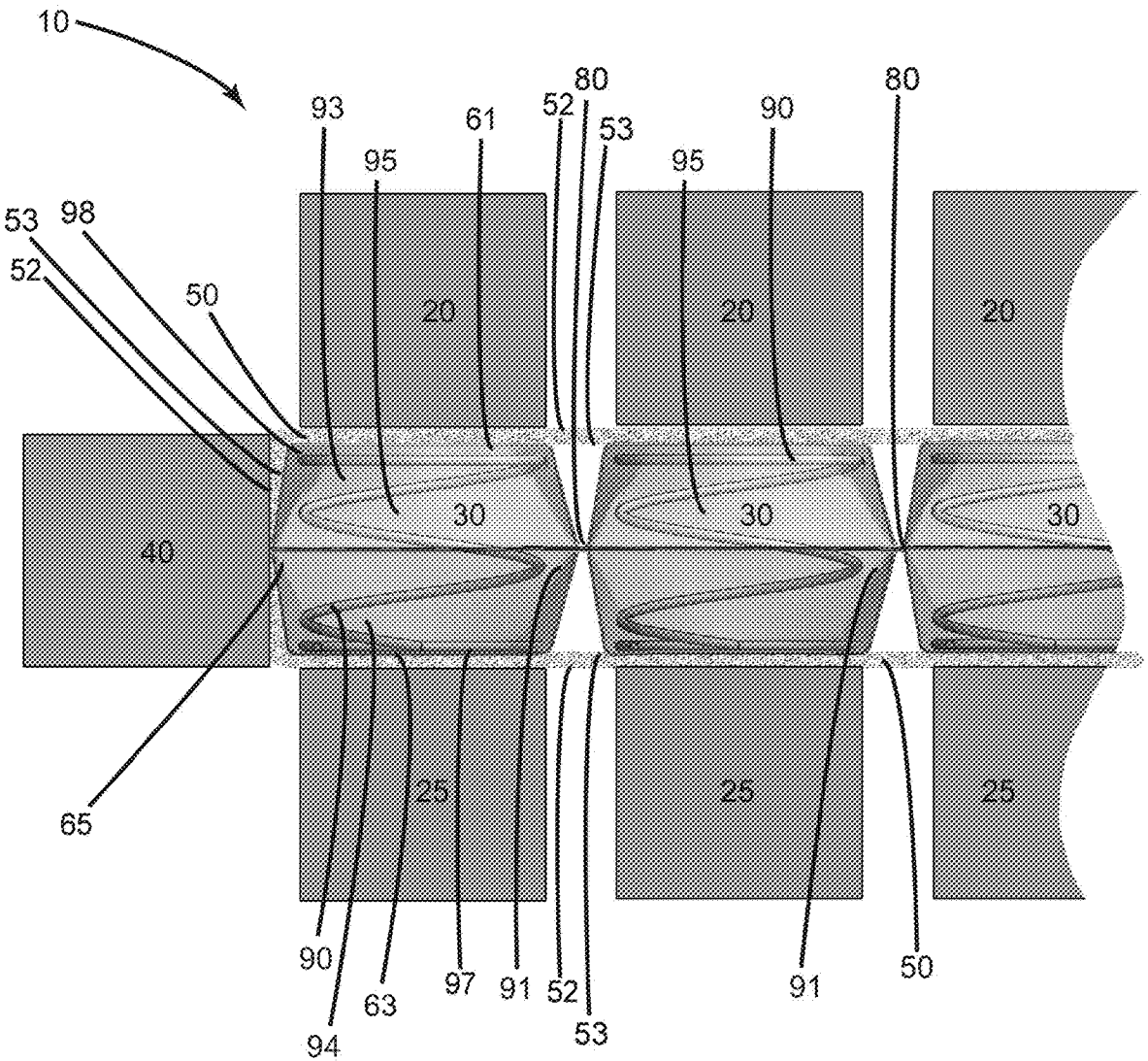
FIG. 4 is a cross section view of the pillow (without the pillow casing) in an unloaded state with an attachment layer that extends from the top cushion elements, past the side cushion elements, and to the bottom cushion elements.

Referring to FIG. 4, that shows a partial cross section view of pillow 10 (without the pillow casing 99) in an unloaded state, attachment layer 50 is shown as a continuous piece of fabric or foam that enables the attachment of top cushion element 20 to the top portion 61 of pocket 95 of each pocket spring 30, then continues on to enable the attachment of side cushion element 40 to the side portion 65 of pocket 95 of the same pocket spring 30, then continues on to enable the connection of bottom cushion element 25 to the bottom portion 63 of pocket 95 of the same pocket spring 30. A major advantage in forming pocket 95 of each of pocket spring 30 with top fabric 93 and bottom fabric 94 attached to form bond 80 having a plane that perpendicular to the central longitudinal axis of the coil spring 90 is one coil spring 90 does physically touch or interfere with an adjacent coil spring 90. Instead, by design, there is a vacant area 91 that exists between coil spring 90 and pocket 95. This vacant area 91 allows the pocket springs to be folded over on one another and therefore allow the sleeper to fold and contour pillow 10 to their particular needs. Also shown is that attachment layer 50 continues on to provide an in plane lateral stability between each pocket springs, as well as providing an in plane lateral stability within the plane of cushion elements 20, as well an in plane lateral stability within the plane of cushion elements 25. Attachment layer 50 comprises an inner and outer surfaces 53 and 52. Attached to outer surface 52 of upper portion of attachment layer 50 is a plurality of foam cushion elements 20 each aligned and acting upon a single pocket spring 30. Attached to the outer surface 52 of lower portion of attachment layer 50 is a plurality of foam cushion elements 25 each aligned and acting upon a single pocket spring 30. Attached to the outer surface 52 of side portion of attachment layer 50 is a foam cushion element 40 aligned with and acting upon a pocket spring unit 30. It is further envisioned, to one skilled in the art, that attachment layer 50 could be made up of multiple sheets of fabric that are bonded together, via stitching, adhesive, thermal bond, or some other bonding agent, to act as a single continuous sheet. Furthermore, by first gluing foam cushion elements 20 and 25 to attachment layer 50, and then adhering attachment layer 50 containing foam elements 20 and 25, to pocket springs 30, or visa-versa, we can simplify the manufacture of pillow 10. It should also be noted that each of upper foam cushion elements 20 and opposing lower foam cushion elements 25 are both engaged and acting upon each of the same pocket springs 30.

Figure 5:
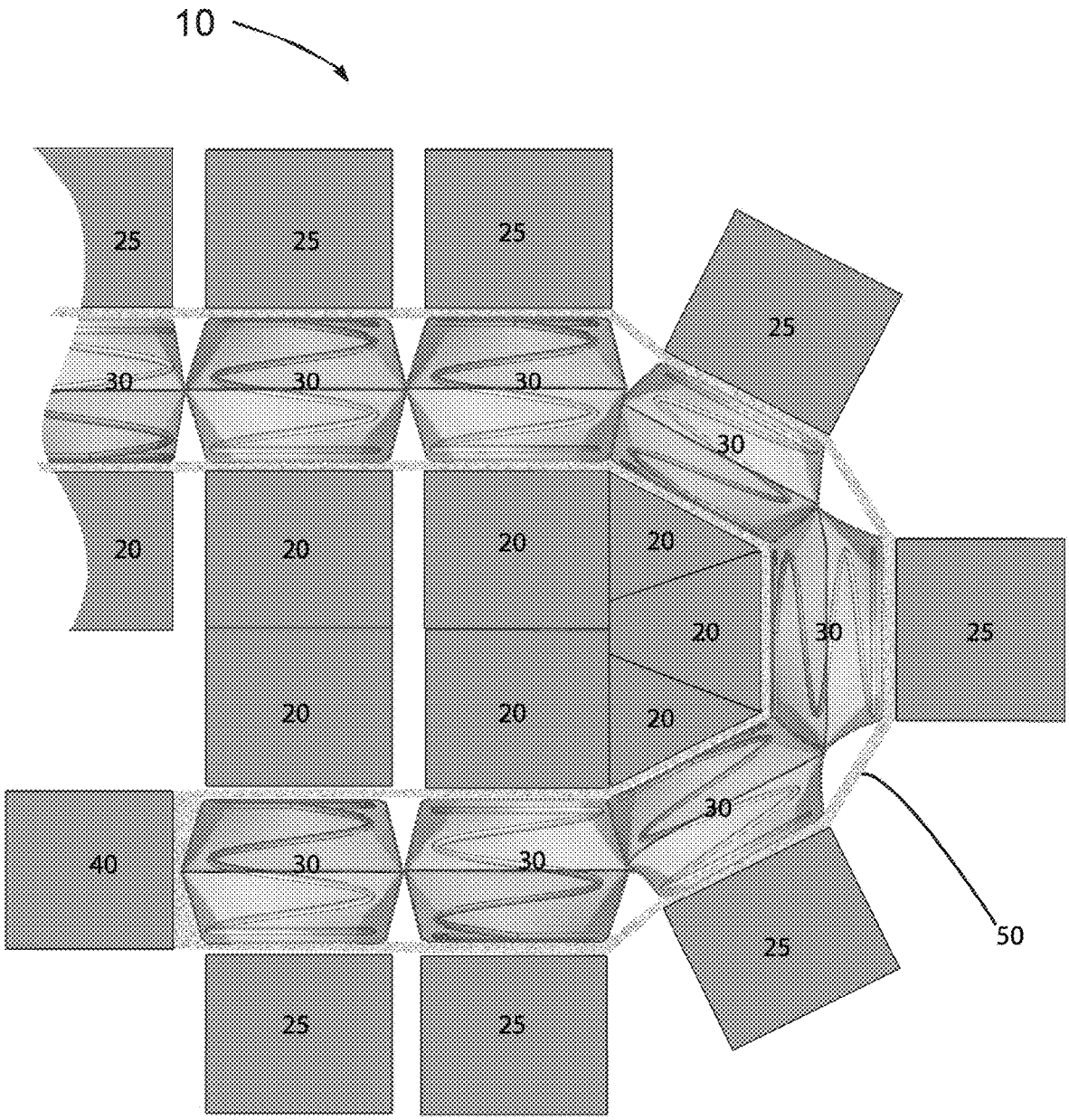
FIG. 5 is a cross section view of the pillow (without the pillow casing) showing the pillow in a state where the pillow has been folded over on itself.

Referring to FIG. 5, where a cross section view shows pillow 10 with one attachment layer 50 that extends from the top cushion elements 20, past the side cushion elements 40, and to the bottom cushion elements 25, in a state where pillow 10 has been folded over on itself. Top cushions elements 20, that fall within the fold zone, are shown compressed and distorted when folded over on one another. At the same time, pocket springs 30 that fall within the fold zone are shown in a partially compressed state due to the forces exerted upon them by the folding action. These same pocket springs 30 that fall within the fold zone have their fabric pockets extended wider than those that fall outside of the fold zone. Attachment layer 50 that falls within the fold zone is also put under tension by the folding action and helps compress pocket springs 30 that fall within the fold zone.

Figure 6:
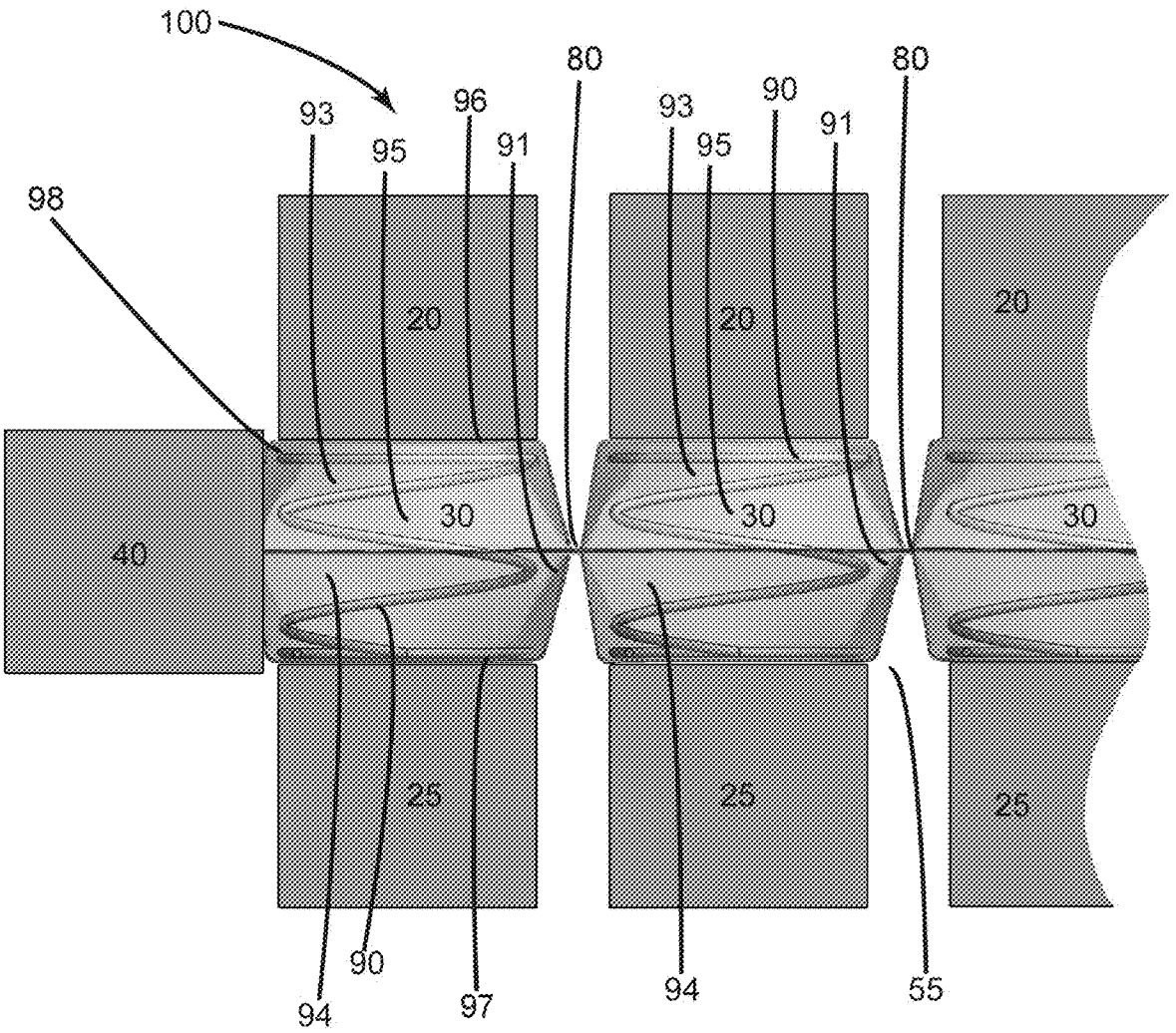
FIG. 6 is a cross section view of a second embodiment of a pillow according to the present invention shown in an unloaded state. The pillow comprises a plurality of pocket springs each comprising a coil spring having a longitudinal axis and a pocket that is formed by two (2) pieces of fabric attached together by a bond having a plane that is perpendicular to the axis of the coil spring; and a cushion element disposed upon each of the pocket spring units.

Referring to FIG. 6, a cross section view of a second embodiment of a pillow 100 according to the present invention shown in an unloaded state. Pillow 100 comprises a plurality of pocket springs 30 as described in the first embodiment. As in the first embodiment, each of pocket springs 30 comprises a coil spring 90 and a pocket 95 that is formed by attaching continuous top piece of fabric 93 to continuous bottom piece of fabric 94 to form a bond 80 having a plane that is perpendicular to the central longitudinal axis of coil spring 90. It should be obvious to anyone who is skilled in the art that the bond between upper fabric piece 93, and lower fabric piece 94 can be, but is not limited to, thermal bonds, stitch bonds, or glue bonds. As in the first embodiment, a major advantage in forming pocket 95 of each of pocket spring 30 with top fabric 93 and bottom fabric 94 attached to form bond 80 having a plane that perpendicular to the central longitudinal axis of the coil spring 90 is one coil spring 90 does physically touch or interfere with an adjacent coil spring 90. Instead, by design, there is a vacant area 91 that exists between the coil spring 90 and pocket 95 in each of pocket springs 30. In addition to bond 80, this vacant area 91 helps pocket springs 30 to be folded over on one another and therefore allow the sleeper to fold and contour the pillow to their particular needs. An upper cushion 20 is attached directly the top fabric 93 of each pocket spring 30 by a glue bond. A lower cushion 25 is directly attached to the bottom fabric 94 of each pocket spring unit 30 by a glue bond. Side cushion 40 is directly attached to both the upper fabric 93 and the lower fabric 94 of pocket cushion 30 by a glue bond. It is further envisioned, to one skilled in the art, that the attachment of cushion elements 20, 25, and 40 to the upper fabric 93 and lower fabric 94 could be accomplished by, but is not limited to, bonding by stitching, adhesive, thermal bond, or some other bonding agent. It should also be noted that an upper cushion 20 and an opposing lower cushion 25 are both engaged with each pocket spring 30.

Figure 7:
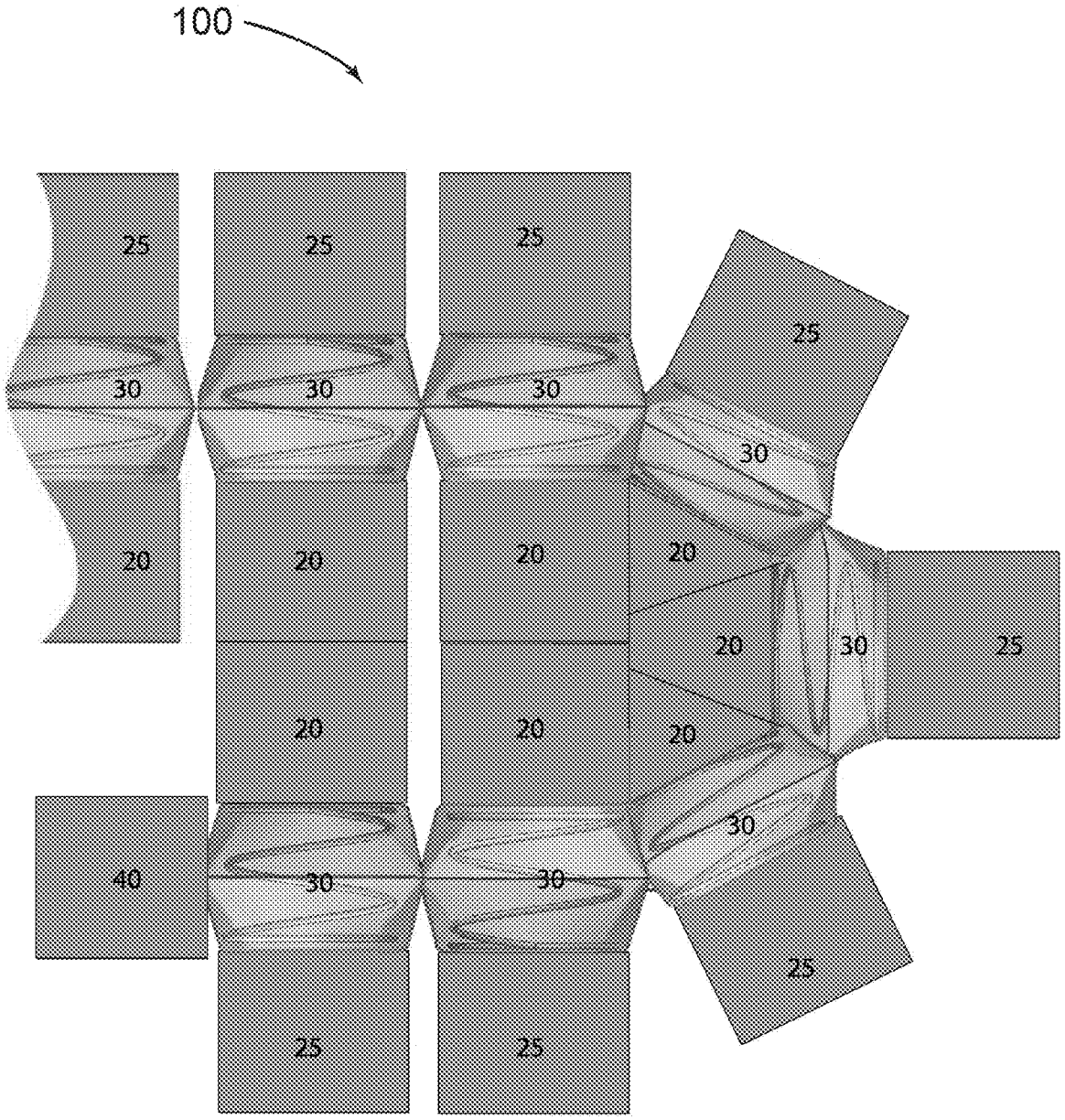
FIG. 7 is a cross section view of the second embodiment of a pillow showing it in a state where the pillow has been folded over on itself.

Referring to FIG. 7, a cross section view of pillow 100 is shown in a state where pillow 10 has been folded over on itself. Top cushions elements 20, that fall within the fold zone, are shown compressed and distorted when folded over on one another. At the same time, pocket springs 30, that fall within the fold zone are shown in a partially compressed state due to the forces exerted upon them by the folding action. These same pocket springs 30, that fall within the fold zone have their fabric pockets extended wider than those that fall outside of the fold zone.

Figure 8:
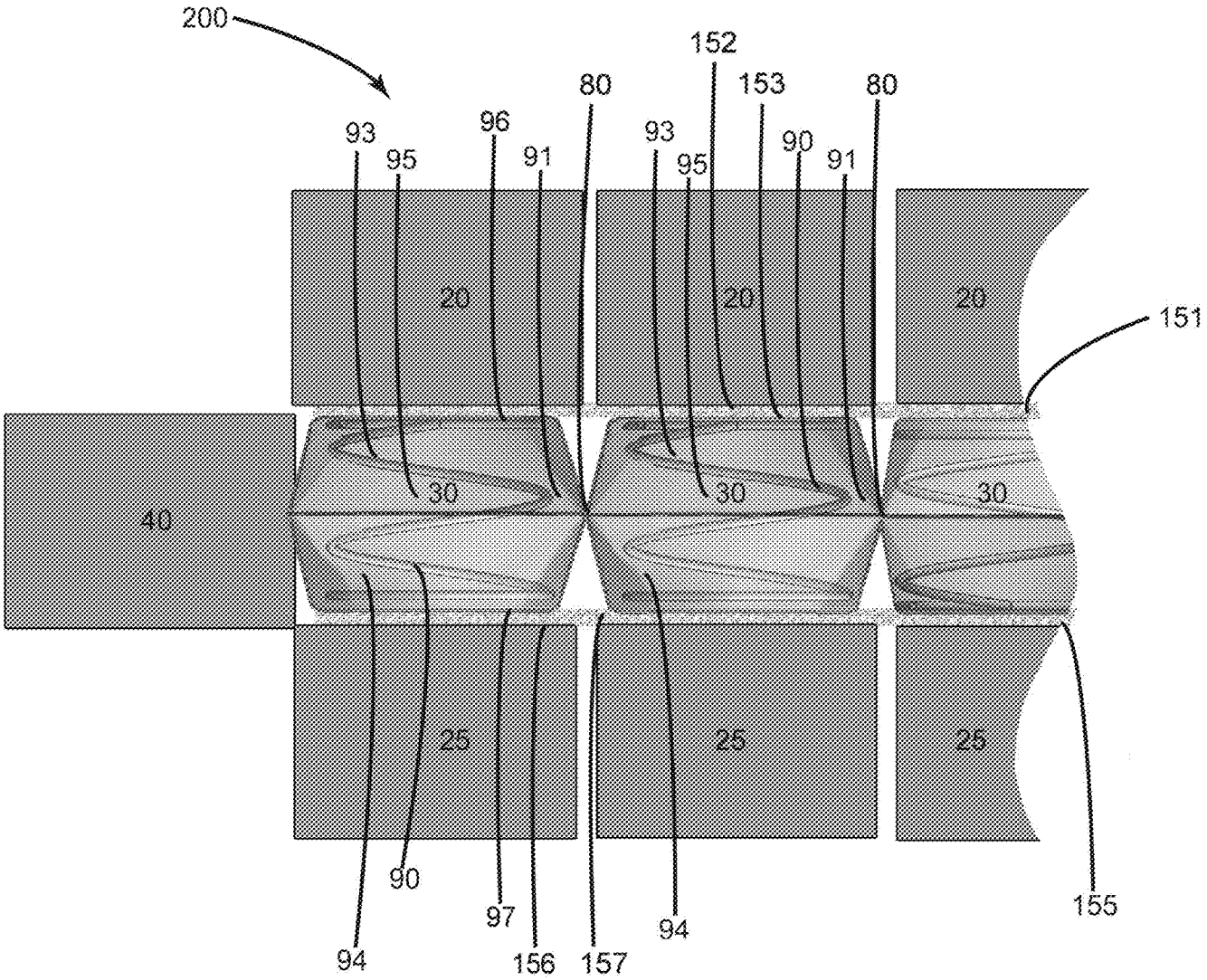
FIG. 8 is a cross section view of a third embodiment of a pillow according to the present invention shown in an unloaded state. The pillow comprises a plurality of pocket spring units each having a coil with having a longitudinal axis and pocket that is formed by two (2) pieces of fabric attached together by a bond having a plane that is perpendicular to the axis of the coil spring; and a cushion element disposed upon each of the pocket spring units, and two separate attachment layers, one between the coil pocket springs and the upper cushion layer and another between the same pocket coil springs and the bottom cushion layer.

Referring to FIG. 8, a cross section view of a third embodiment of a pillow 200 according to the present invention is shown in an unloaded state (without a pillow casing). Pillow 200 of the third embodiment is the same as the pillow 10 of the first embodiment except that attachment layer 50 is made up of individual separate pieces. Pillow 200 comprises a plurality of pocket springs 30, a separate upper attachment layer 151, shown as a continuous piece of fabric that enables the attachment of upper cushion element 20 to the top of each pocket spring 30, a separate lower attachment layer 155, shown as a continuous piece of fabric that enables the attachment of lower cushion element 25 to the bottom of each pocket spring 30. Each pocket spring 30 comprises a coil spring 90 and a pocket 95 formed by a continuous top piece of fabric 93 attached to a continuous bottom piece of fabric 94 to form a bond 80 that is perpendicular to the central longitudinal axis of coil spring 90. It should be obvious to anyone who is skilled in the art that attachment layers 151 and 155 can be made from, but is not limited to, woven fabrics, non-woven fabrics, foams, plastics, or other sheet materials. As in the first embodiment, a major advantage in forming pocket 95 of each of pocket spring 30 with top fabric 93 and bottom fabric 94 attached to form bond 80 having a plane perpendicular to the central longitudinal axis of the coil spring 90 that does not physically touch or interfere with an adjacent coil spring 90. Instead, by design, there is a vacant area 91 that exists between the coil spring 90 and pocket 95 in each of pocket springs 30. This vacant area 91 along with bond 80 help pocket spring 30 fold over upon another pocket spring 30 and therefore allow the sleeper to fold and contour pillow 200 to their particular needs. Attachment layer 151 comprises an inner and outer surface 153 and 152. Attached to the outer surface 152 of upper attachment layer 151 is a foam cushion element 20 aligned with top portion 96 of pocket 95 of each pocket spring 30. Attachment layer 155 comprises an inner and outer surface 157 and 156. Attached to the outer surface 156 of lower attachment layer 155 is a foam cushion element 25 aligned with bottom portion 97 of pocket 95 of each pocket spring 30.

Figure 9:
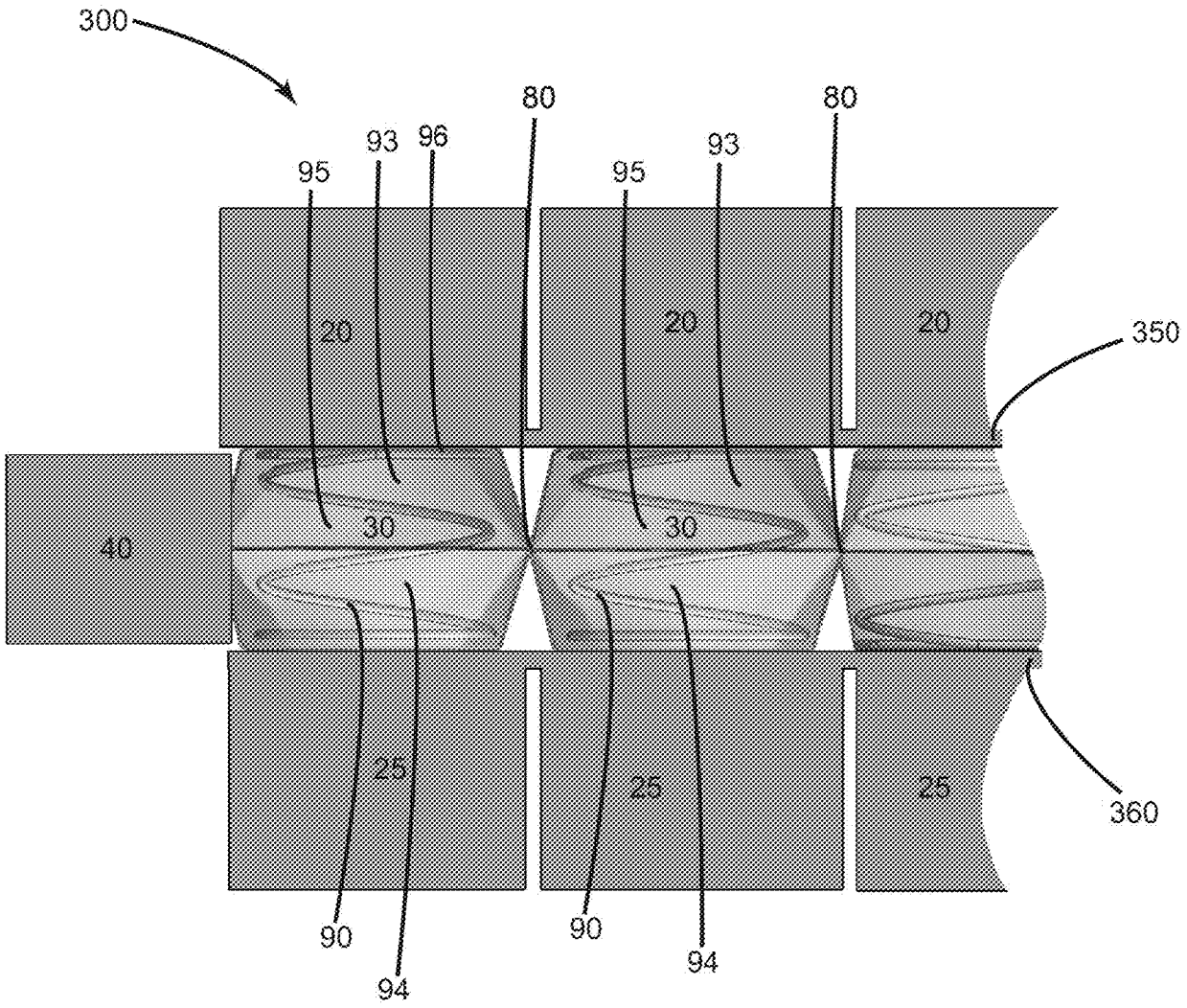
FIG. 9 is a cross section view of a fourth embodiment of the pillow in an unloaded state with an upper integral attachment layer and a separate lower integral attachment layer.

Referring to FIG. 9, is a cross section view of a fourth embodiment of a pillow 300 according to the present invention shown in an unloaded state, showing a cutaway view of pocket springs 30, a separate integral upper attachment layer

350 shown as a continuous piece of foam that is formed out of a solid piece of foam from which the upper cushion elements 20 are also formed. The method of forming integral attachment layer 350 and cushion elements 20 is accomplished by cutting the contour of cushion elements 20 out of a solid slab of foam, but only cutting deep enough to leave an integral attachment layer 350 that extends from the bottom of each cushion element 20. The bottom of integral attachment layer 350 is bonded to each of pocket springs 30 by an adhesive. Also present is a separate lower integral attachment layer 360, shown as a continuous piece of foam that is formed out of a solid piece of foam from which each lower cushion element 25 are also formed. The method of forming integral attachment layer 360 and cushion elements 25 is accomplished by cutting the contour of each cushion elements 25 out of a solid slab of foam, but only cutting deep enough to leave an integral attachment layer 360 that extends from the bottom of each cushion elements 25. The top of integral attachment layer 360 is bonded to each pocket spring 30 by an adhesive. It is further envisioned, to one skilled in the art, that the attachment of each pocket spring 30 to integral attachment layer 350, and integral attachment layer 360, could be accomplished by, but is not limited to, bonding by stitching, gluing, ultrasonic, thermal bond, or some other bonding agent. It is also envisioned, to one skilled in the art, that integral attachment layer 350 and 360, as well as their integral cushion elements 20 and 25, can be fabricated from a single piece of foam that is poured into a mold. Such a fabrication method eliminates waste and eliminates foam cutting. It is further envisioned that the characteristics of the molded or cut foam can possess substantially similar characteristics to convoluted foam.

While particular embodiments of the invention have been shown and described, it will be obvious to those skilled in the art that changes and modifications may be made without departing from the scope of the claimed invention.

What is claimed:

1. A pillow comprising:

a plurality of pocket springs; each of said pocket springs comprising a coil spring comprising a central longitudinal axis and a pocket; each of said pockets comprising a top portion and a bottom portion; each of said pockets are formed from a continuous top piece of fabric attached to a continuous bottom piece of fabric to form a bond having a plane perpendicular to said central longitudinal axis of each coil spring thereby allowing movement of each pocket spring;

an attachment layer comprising a top portion comprising an inner surface and an outer surface; and a plurality of first cushion elements engaged with said outer surface of said top portion of said attachment layer; said inner surface of said top portion of said attachment layer being engaged with said top portion of said pockets of said pocket springs such that each of said first cushion elements acts only upon one of said pocket springs.

2. The pillow of claim 1, wherein said attachment layer further comprises a bottom portion comprising an inner surface and an outer surface; the pillow further comprising a plurality of second cushion elements engaged with said outer surface of said bottom portion of said attachment layer; said inner surface of said bottom portion of said attachment layer being engaged with said bottom portion of said pockets of said pocket springs such that each of said second cushion elements acts only upon one of said pocket springs.

3. The pillow of claim 2, wherein said attachment layer further comprises a side portion comprising an inner surface and an outer surface; the pillow further comprising a plurality of third cushion elements engaged with said outer surface of said side portion of said attachment layer; said inner surface of said side portion of said attachment layer being engaged with a side portion of each of said pocket springs such that each of said third cushion elements acts only upon one of said pocket springs.

4. The pillow of claim 3, wherein said top portion, said bottom portion and said side portion of said attachment layer are made from a single piece of material.

5. The pillow of claim 3, wherein each of said first cushion elements, said second cushion elements, and said third cushion elements are made from a foam material.

6. The pillow of claim 3, wherein said first cushion elements are attached to said outer surface of said top portion of said attachment layer by adhesive.

7. The pillow of claim 3, wherein said second cushion elements are attached to said outer surface of said bottom portion of said attachment layer by adhesive.

8. The pillow of claim 3, wherein said third cushion elements are attached to said outer surface of said side portion of said attachment layer by adhesive.

9. The pillow of claim 1, wherein said attachment layer and said plurality of first cushion elements are made from a single piece of foam.

* * * * *